US007069996B2

(12) United States Patent
McGarian

(10) Patent No.: US 7,069,996 B2
(45) Date of Patent: Jul. 4, 2006

(54) COMPLETION OF LATERAL WELL BORES

(75) Inventor: Bruce McGarian, Aberdeen (GB)

(73) Assignee: Smith International, Inc., Houston, TX (US)

( * ) Notice: Subject to any disclaimer, the term of this patent is extended or adjusted under 35 U.S.C. 154(b) by 230 days.

(21) Appl. No.: 10/485,962

(22) PCT Filed: Aug. 1, 2002

(86) PCT No.: PCT/GB02/03550

§ 371 (c)(1),
(2), (4) Date: Feb. 6, 2004

(87) PCT Pub. No.: WO03/014519

PCT Pub. Date: Feb. 20, 2003

(65) Prior Publication Data

US 2004/0231850 A1 Nov. 25, 2004

(30) Foreign Application Priority Data

Aug. 7, 2001 (GB) ..... 0119241.8

(51) Int. Cl.
*E21B 19/16* (2006.01)
*E21B 43/00* (2006.01)

(52) U.S. Cl. ..... 166/313; 166/255.3; 166/50

(58) Field of Classification Search ..... 166/313, 166/50, 255.3
See application file for complete search history.

(56) References Cited

U.S. PATENT DOCUMENTS

| | | | | |
|---|---|---|---|---|
| 6,053,254 | A | 4/2000 | Giano | |
| 6,899,183 | B1 * | 5/2005 | Dewey et al. | 166/387 |
| 2002/0000319 | A1 * | 1/2002 | Brunet | 166/313 |
| 2004/0016547 | A1 * | 1/2004 | Brunet et al. | 166/313 |

FOREIGN PATENT DOCUMENTS

| | | |
|---|---|---|
| GB | 2368862 | 5/2002 |
| WO | 0188336 | 11/2001 |
| WO | 0202900 | 1/2002 |

* cited by examiner

*Primary Examiner*—William Neuder
(74) *Attorney, Agent, or Firm*—Dykema Gossett PLLC

(57) ABSTRACT

The present invention relates to the completion of lateral well bores and provides a method comprising the steps of installing a datum device in a main well bore so as to provide a datum height above the lateral: making a completion string (10) comprising a lateral lining (11), a window element (14) at an upper end of the lining (11), a swivel joint (15) located between the lining (11) and the window element (14), and a datum device engaging member (21) located above the window element (14); running the completion through the main well bore and into the lateral; rotating the window element (14) to place the window at a desired angular position; and running the completion string home to engage the datum device engaging member (21) with the datum device.

6 Claims, 2 Drawing Sheets

COMPLETION OF LATERAL WELL BORES

BACKGROUND OF THE INVENTION

This invention relates to the completion of lateral well bores, and in the preferred embodiment provides a relatively simple and inexpensive arrangement which facilitates passage of relatively large diameter objects into a completed lateral well bore whilst permitting passage of relatively large diameter objects past the lateral well bore into the portions of the original well bore located below the lateral.

In recent years, the technique of producing lateral well bores (also known as "laterals" and "branch well bores") has been significantly developed. Laterals are well bores which are drilled to branch off an existing main well bore in order to gain access to the strata surrounding the main well bore. Typically, one or more laterals will be drilled from a main well bore starting from a point somewhat above hydrocarbon bearing strata surrounding the main well bore. The laterals are generally bored away from the main well bore in a generally downward direction (although horizontal or even upwardly extending laterals are known) to arrive in the hydrocarbon bearing strata at a point displaced from the main well bore. By this means, hydrocarbon material can be extracted from the formation surrounding the main well bore without drilling a fresh well bore from the surface.

In order to maximise the benefit of the lateral technique it is common to bore several laterals spaced apart angularly around the main well bore. Such arrangements are known as "multilaterals". A number of arrangements for drilling laterals and multilaterals are disclosed, for example, in published International patent application WO 94/03699.

Especially in the case of multilaterals (although to an extent also in the case of single laterals) it is often desirable to have communication from a point in the main well bore above a lateral to a point in the main well bore below the lateral. Such communication may be used, for example, to permit hydrocarbon material to flow from a lower lateral past an upper lateral to the surface. In more sophisticated arrangements, access may be required past a lateral to allow service or development tools to be run past the lateral to work at a location below the lateral.

A number of arrangements have been proposed to facilitate this desirable communication between portions of the main well bore above a lateral and portions of the main well bore below the lateral.

In one early example of these techniques disclosed in U.S. Pat. No. 245,920 (Shell) a continuous casing is inserted to extend from a point in the main well bore above a lateral to a point below the lateral. After cementing, the main casing is perforated to provide fluid communication between those portions of the original main well bore located below the lateral and those portions of the original main well bore located above the lateral.

In WO 94/03699 a number of techniques are disclosed. In particular, in one technique it is proposed to install a lateral liner so that a portion of the liner resides in the main well bore, to cement the lateral liner in position, and then to wash over the portions of the lateral liner which reside in the main well bore with a view to producing a clean inverted Y junction. Also disclosed in WO 94/03699 is a technique whereby the lateral liner is installed with a portion of the lateral liner located in the main well bore above the lateral junction, the lateral liner is cemented in position, and a milling tool is run through the lateral liner along the central axis of the original main bore to form a milled opening in the lateral liner to facilitate communication between the portions of the main bore located below the lateral and portions of the main well bore located above the lateral.

More recently, U.S. Pat. No. 5,477,925 proposes use of a pre-formed window element which forms part of a completion string for the lateral. As proposed, the window element includes means for hooking onto the window formed in the casing of the main well bore. Such an arrangement ensures that the window element is located at precisely the correct depth relative to the window in the main well bore casing so as provide through communication between the portions of the main well bore located respectively above and below the lateral. Whilst this device represents a substantial improvement over the techniques of earlier proposals, the system does suffer from the advantage that the entire completion string must be correctly angularly oriented throughout the process of running the completion string into the lateral. This is because it is only by maintaining the correct angular orientation of the completion string that the window element will be presented to the main well bore casing window at the correct orientation to ensure seating.

All the above arrangements are characterised by one or more disadvantages. The technique of U.S. Pat. No. 2,452,920 provides fluid communication but does not permit the passage of tools between the portions of the main well bore above and below the lateral. Also, the technique of U.S. Pat. No. 2,452,920 requires precise positioning of a perforating tool which may not, in practice, be possible in many cases. The washover technique of WO 94/03699 can produce a clean inverted Y junction. However, the technique requires an additional somewhat uncertain operation (the washover operation) and can result in a unstable junction if applied to laterals drilled into unstable formations. The mill through technique of WO 94/03699 obviates the problem of an unstable junction but may be difficult to achieve in practice because the mill tool will tend to follow the lateral liner into the lateral rather than bore straight through the lateral liner as suggested by the illustrations of the patent specification. The technique of U.S. Pat. No. 5,477,925 requires the maintenance of the correct angular position of the lateral lining as it is run into the lateral to ensure that the window element is at the correct angular position relative to the main well bore casing window.

We have now devised a relatively simple technique which provides communication between the portions of a main well bore located above and below a lateral and which overcomes the disadvantages of the prior art outlined above.

SUMMARY OF THE INVENTION

In accordance with one aspect of the present invention a method of completing a lateral well bore comprises installing a datum device in a main well bore at a point above the lateral, the datum device providing a datum height above the lateral; making up a completion string comprising a lining to be inserted in the lateral bore, a window element at the upper end of the liner, a swivel joint between the lining and the window element, and a datum device engaging member located above the window element; running the completion through the main well bore and into the lateral until at least a portion of the lining is located in the lateral; rotating the window element to place the window at a desired angular position relative to the main well bore; and running the completion string home to engage the datum device engaging member with the datum device.

By use of the method according to the present invention the bulk of the lateral completion (which may be several hundred meters in length) may be run into the lateral before the window element is rotated to achieve the correct angular orientation. The swivel between the window element and the casing facilitates rotation of the window element without requiring rotation of the casing. The engagement of the datum device ensures that the completion is run precisely the correct depth so that the window in the window element facilitates communication between the portions of the main well bore located above and below the lateral.

Preferably, the datum device provides an angular datum reference as well as a height datum reference. Accordingly, rotation of the window element to the correct angular orientation may be achieved by reference to the datum device. In a particularly preferred embodiment of the invention the datum device has a muleshoe engaging profile and the datum device engaging member secured to the window element comprises a muleshoe. By this means, as the completion is run home the engagement of the muleshoe with the datum device will automatically rotate the muleshoe and the window element to place the window element in the correct angular orientation. It will be noted that it may be desirable to provide for adjustment of the angular orientation of the muleshoe relative to the completion so that any errors in setting the datum device can be compensated for by a corresponding adjustment to the position of the muleshoe.

The datum element may be of any convenient form. In general, it will be desirable for the datum element to occupy the minimum possible annular zone within the main well bore so as to maximise the available diameter for the passage of the lateral completion. To this end, the datum device can be of the known big bore packer type set in the casing at the required position before the completion is run. However, in a particularly preferred embodiment of the inventions the datum device is a thin walled device, for examples, a tubular which has been expanded into locking engagement with the casing of the main well bore. In a particularly preferred embodiment of the invention, the datum device is in the form of the attachment device described in U.S. Pat. No. 6,899,183, the disclosure of which is incorporated herein by reference. This device provides a simple and secure angular and height datum and yet occupies only a small annular zone within the main well bore.

The invention will be better understood from the following description of a preferred embodiment thereof, given by way of example only, reference being had to the accompanying drawings.

DETAILED DESCRIPTION OF THE PREFERRED EMBODIMENT

Figure 1:
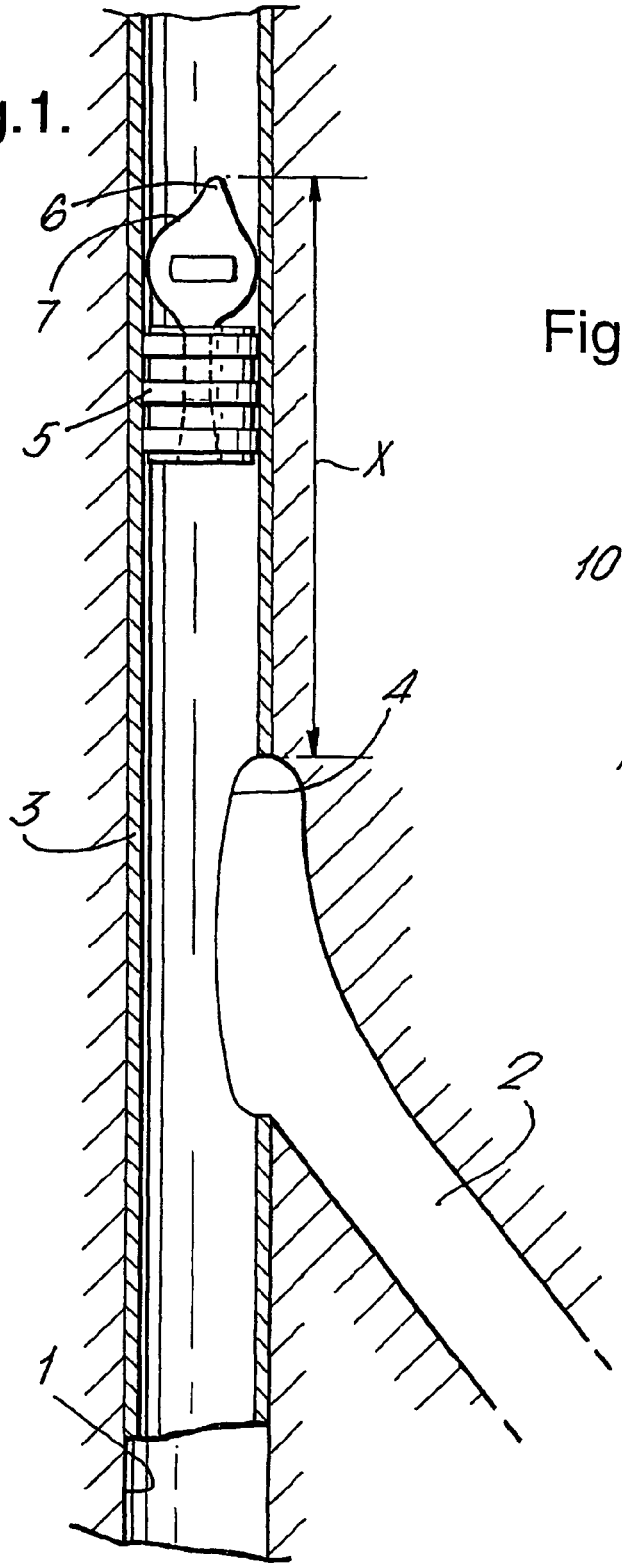
FIG. 1 illustrates a main well bore having a lateral drilled therefrom, a thin walled device being positioned in the main well bore above the lateral.

Referring firstly to FIG. 1, there is shown a main well bore 1 having a lateral well bore 2 drilled therefrom. The techniques necessary to drill the lateral are well established within the well drilling art. As illustrated, the main well bore 1 is fitted with a steel casing 3 which is cemented in position. The process of forming the lateral produces a window 4 in the casing 3. As illustrated, the lateral 2 is not lined.

A datum device 5, in the form of an attachment device in accordance with the description of the aforementioned U.S. provisional patent application, is shown mounted within the main well bore casing 3 at a point above the window 4. The device 5 has been installed after the window has been formed, at a known spatial and angular position relative to the window 4. Any appropriate technique may be used for correctly positioning the device 5 prior to setting. Because the device 5 has a fixed spatial and angular relationship to the window 4 the point 6 at the top of the device 5 is at a known spacing X from the top of the window 4. Similarly, the point 6 has a known angular relationship to the top of the window 4. As illustrated, the point 6 is offset by 90° in the anti-clockwise direction (when viewed from above) relative to the top of the window 4.

Whilst the datum device 5 is preferably as disclosed in the aforesaid U.S. provisional patent application, it is to be appreciated that other datum device may be used. For example, a big bore packer or similar device may function as the datum device. Alternatively, a tubular may be expanded into locking engagement with the casing 3. The essential characteristics of the datum device is that it provides a datum height X above the window 4. Preferably, the datum device also provides a known angular relationship relative to the window 4. As illustrated, the upper surface 7 of the device 5 has a muleshoe engaging profile the uppermost extremity of which provides the point 6 for datum angular reference.

It will be appreciated that whilst in the above description the datum distance has been described as between the point 6 and the upper edge of the window 4, the datum distance may equally be defined as the distance between the point 6 and the lower edge of the window 4 or the centre line of the lateral 2. The only important factor is that the datum distance provides a datum reference point having a known spatial relationship to the window 4 and the lateral 2.

Figure 2:
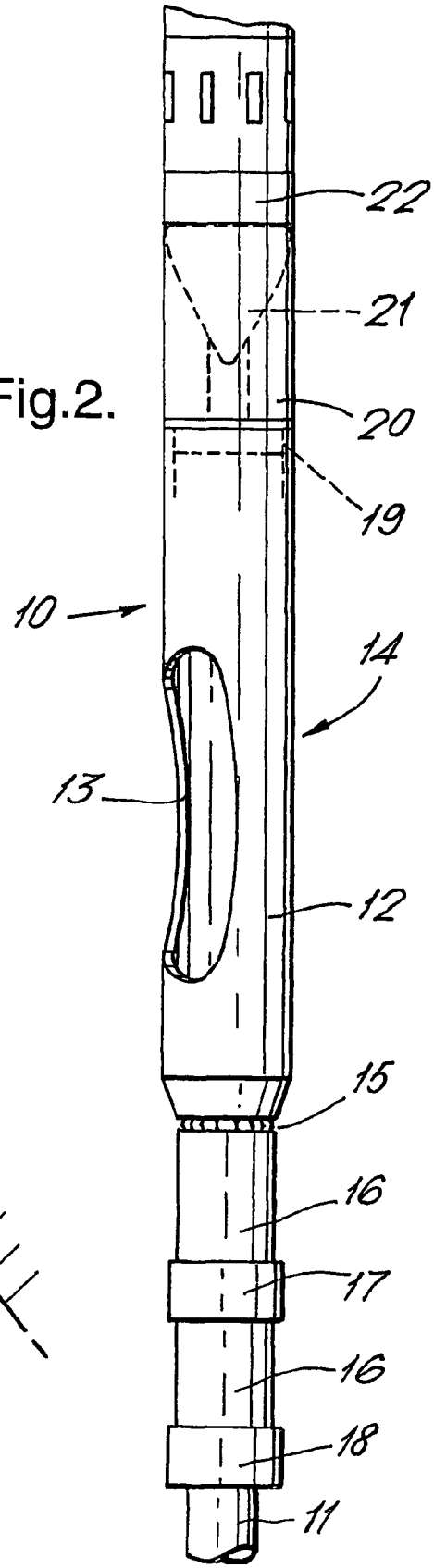
FIG. 2 illustrates the upper portion of a completion string in accordance with the preferred embodiment to the present invention.

Referring now to FIG. 2, there is shown schematically a completion string 10 in accordance with the preferred embodiment of the present invention.

The lower part of the completion string includes a liner 11 which, in use, will be positioned within the lateral 2. The lining 11 may be several hundred meters in length and may include known tools for performing specific operations within the lateral.

Located above the casing 11 is a transition joint 12 which has formed therein a window 13. The joint 12 forms a window element 14 the function of which will be clear from the following description with reference to FIG. 3. Immediately below the window element 14 is a swivel 15 which allows rotation of the window element and the components above it relative to the components below it. According to the exact requirements for the completion a range of joints 16 and tools 17, 18 may be positioned between the swivel 15 and the casing 11. The tools 17, 18 may, for example, be a CPC (cementing port collar) 17 and an ECP (external casing packer) 18.

The upper end of the window element 14 is secured by means of a threaded connection 19 to a joint 20 having thereon a muleshoe 21 the profile of which is complementary to the muleshoe engaging profile 7 of the datum device 5. A packer 22 is located above the joint 20. Other components as required may be located above the packer 22.

Figure 3:
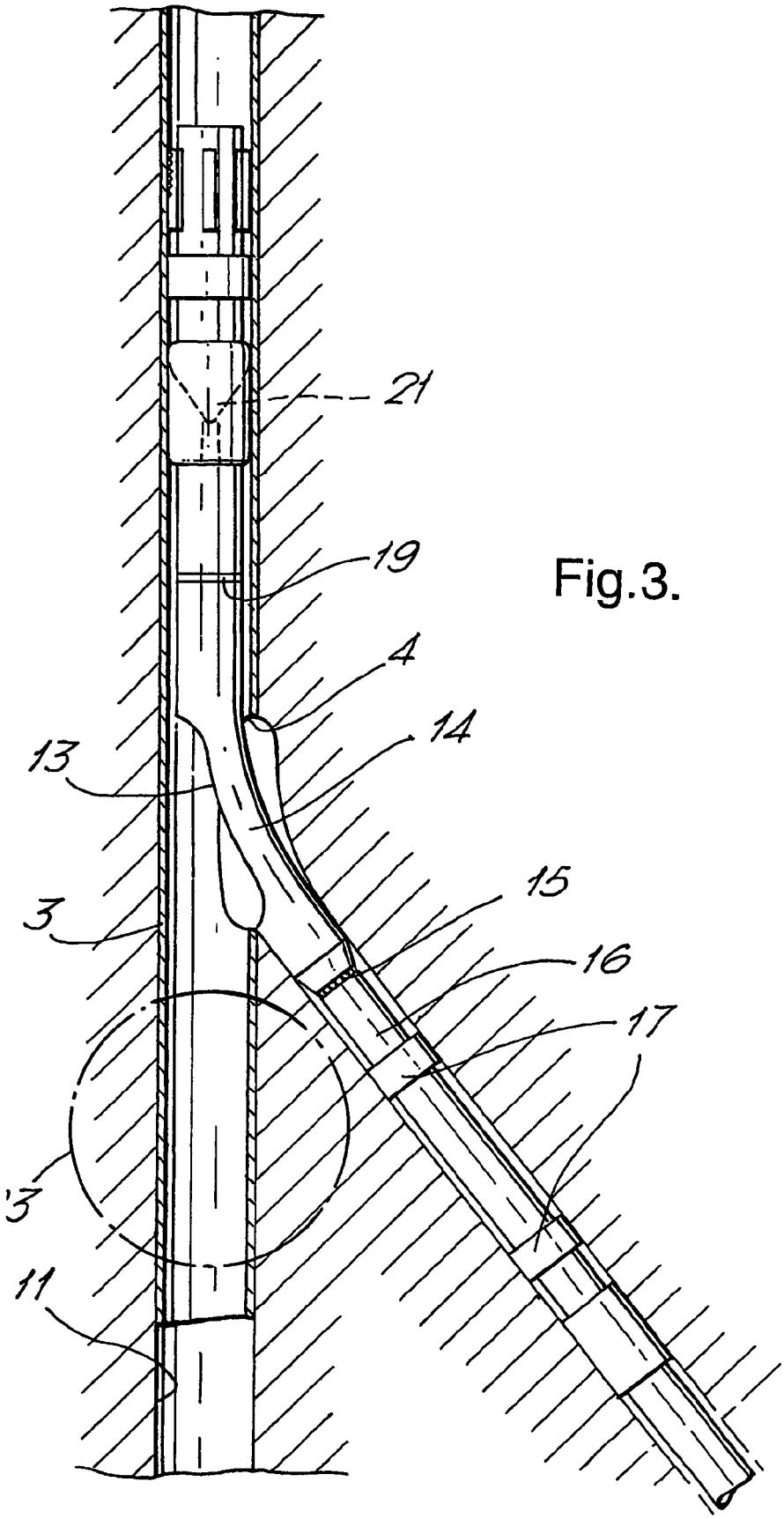
FIG. 3 illustrates the completion string of FIG. 2 positioned within the main well bore and lateral illustrated in FIG. 1.

In use, the completion 10 is run into the main well bore 1. The casing 11 is deflected into the lateral 2. Deflection may be achieved by means of a deflector device positioned within the main well bore 1 or may be achieved automatically by suitably shaping the lower extremity of the casing to kick into the lateral. Once the casing has entered the lateral 2 the completion is run almost home without any attempt to control the rotational position of the components of the completion. Accordingly, the completion can be run into the lateral relatively easily. This situation continues until the muleshoe 21 of the completion engages the muleshoe engaging profile 7 of the datum device 5. Once this happens, further downward movement of the completion will cause rotation of the completion components located above the swivel 15. The swivel 15 allows the components located above it to rotate as required by the muleshoe profiles, without having to rotate the casing which has already entered the lateral. Eventually, the muleshoe 21 bottoms on the muleshoe engaging profile 7 of the device 5. This configuration is shown in FIG. 3. It will be noted that the effect of this arrangement is to position the window 13 of the window element 14 at a precisely known location relative to the window 4 of the main well bore casing. The positioning of the window 13 is both translational and rotational. In other words, the window 13 will be positioned at a precisely known depth relative to the window 4 and at a precisely known angular position relative thereto. If desired a packer anchor may be provided at the top of the completion to lock the completion in position and provide a seal between the completion and the primary casing 3.

As illustrated in FIG. 3, the window 13 facilitates the passage of tooling through the upper portion of the completion 10 and outwardly through the window 13 into the portions of the main well bore 1 located beneath the lateral. Equally, tooling can pass through the upper portions of the completion 10 and through the window element 14 into the lateral.

It will be appreciated that the invention provides a simple and reliable technique for completing a lateral and, at the same time, providing access to the regions of the main well bore located beneath the lateral. Once the datum device 5 has been set the entire completion operation can be completed in a single trip. The perforation, wash over or milling techniques of the prior art are not required.

It will be noted that because of the relatively small annular zone occupied by the datum device 5 the joint 20 and window element 14 may have a relatively large diameter and accordingly facilitate relatively large diameter access to both the lateral and the main well bore. It is envisaged that in a typical main well bore having a casing with a diameter of 9⅝ inch the datum device 5 of the preferred embodiment will facilitate passage of a completion having an outside diameter of between 7 inch and 7⅝ inch thereby permitting access through the window 13 of tools having a diameter of between 6 inch and 6¼ inch.

It will be noted that if desired a datum device may be positioned within the zone 23 below the lateral. Such a datum device may be of any suitable type, for example a big bore packer, an expanded tubular, or an attachment device as described in the aforementioned U.S. provisional patent application. Such a datum device may, for example, be used to support a deflector for the purpose of deflecting the completion into the lateral, or for supporting a deflector for deflecting tools into the lateral. Such deflectors may be recoverable. Additonally or alternatively a datum device in the zone 23 may be used to support a completion similar to that described above which is associated with a further lateral location below that illustrated in the drawing.

It will be appreciated that whilst the invention has been described in the context of an unlined (bare foot) lateral the invention may be applied to laterals which have previously been lined by, for example, the washover technique described in WO 94/03699.

The invention claimed is:

1. A lateral borehole completion string for use in a wellbore that comprises a main borehole and a lateral borehole, the main borehole having a casing formed with a window to permit passage of a lateral lining into the lateral borehole and having a datum device secured to the casing, the lateral borehole completion string comprising: a lining to be inserted in the lateral borehole; a window element at an upper end of the lining; a swivel joint located between the lining and the window element; and an engaging member located above the window element, which engaging member, in use, is run into engagement with the datum device to stop downward movement of the window element.

2. A lateral borehole completion string according to claim 1, wherein the engaging member comprises means for automatically ensuring the engaging member locates in a predetermined rotational position relative to the datum device when the engaging member is, in use, run into engagement with said datum device.

3. A lateral borehole completion string as claimed in claim 2, wherein said means for ensuring location of the engaging member comprises a muleshoe.

4. A method of completing a lateral well bore, the method comprising the steps of installing a datum device in a main well bore at the point above the lateral well bore, the datum device providing a datum height above the lateral; making up a completion string comprising a lining to be inserted in the lateral borehole, a window element at an upper end of the lining, a swivel joint located between the lining and the window element, and a datum device engaging member located above the window element; running the completion string through the main well bore and into the lateral well bore until at least a portion of the lining is located in the lateral well bore; rotating the window element so as to place the window at a desired angular position relative to the main well bore; and running the completion spring home so as to engage the datum device engaging member with the datum device and thereby stop downward movement of the window element.

5. A method as claimed in claim 4, wherein the datum device provides an angular datum reference as well as a height datum reference so that rotation of the window element to the correct angular position is achieved by reference to the datum device.

6. A method as claimed in claim 5, wherein the datum device comprises a muleshoe engaging profile and the datum device engaging member comprises a muleshoe.

* * * * *